US005224623A

United States Patent [19]

LaFleur

[11] Patent Number: 5,224,623

[45] Date of Patent: Jul. 6, 1993

[54] FAST FOOD CONTAINER

[75] Inventor: John A. LaFleur, Richmond, Va.

[73] Assignee: Amoco Corporation, Chicago, Ill.

[21] Appl. No.: 722,112

[22] Filed: Jun. 27, 1991

[51] Int. Cl.[5] ..... B65D 23/00

[52] U.S. Cl. ..... 220/669; 220/674; 220/675; 206/217

[58] Field of Search ..... 220/671, 673, 675, 669, 220/674; 206/217

[56] References Cited

U.S. PATENT DOCUMENTS

| | | | |
|---|---|---|---|
| 3,472,418 | 10/1969 | Ullman | 220/672 |
| 4,446,969 | 5/1984 | Tyler | 220/675 |
| 4,538,439 | 9/1985 | Frei | 220/672 |
| 4,610,366 | 9/1986 | Estes et al. | 220/672 |
| 4,631,715 | 12/1986 | Hoover | 206/217 |
| 4,781,301 | 11/1988 | Le Bret et al. | 220/672 |
| 4,863,058 | 9/1989 | Antoni et al. | 220/675 |
| 5,010,013 | 4/1991 | Serkes et al. | 220/672 |

FOREIGN PATENT DOCUMENTS

| | | | |
|---|---|---|---|
| 1500560 | 8/1989 | U.S.S.R. | 220/672 |

*Primary Examiner*—Joseph Man-Fu Moy

*Attorney, Agent, or Firm*—Matthew R. Hooper; Stephen L. Hensley; Frank J. Sroka

[57] ABSTRACT

An improved open-top container which is reinforced by ribs which wrap around the container side walls to supply reinforcement in both the axial and radial directions, while also providing for nesting into a similar container for improved transport and durability.

11 Claims, 1 Drawing Sheet

FAST FOOD CONTAINER

FIELD OF THE INVENTION

This invention relates to a container comprising a base member at a smaller end of the container and having an opening at a larger end thereof and a side wall sloping from said base member and including a substantially spirally would rib including a portion extending inwardly and a portion extending outwardly from said sidewall.

BACKGROUND OF THE INVENTION

Over the years a number of containers, receptacles and trays and processes relating thereto have been developed. Typifying many of these prior art containers are those found in U.S. Pat. Nos. Des. 353,331, Des. 196,003, Des.271,169, Des.192,103, Des.280,705, 3,396,062, 3,495,736, 1,126,364 and 4,540,543.

Plastic containers made of foamed polystyrene and other materials are widely used in the food service field where containers are filled, stored and supplied to the consumer at a later time. Applicant has developed improved containers such as found in commonly assigned U.S. Pat. Nos. 4,150,777 and 4,253,600 which offer significant advances over the art.

Small containers have been used in cafeterias, fast food establishments, restaurants and the like for holding food, such as pudding, ice cream, salads, soups, etc. In connection with school cafeterias, for example, the cost of washing dishes is among the higher costs for such an operation. In order to reduce costs, there is a need for containers which are disposable and recyclable.

Plastic containers have been available in the food service field for some time. In the case of polystyrene containers, such containers are inherently weak or flimsy in both the axial and radial directions and are prone to spinning, which can cause spillage. These disadvantages can be particularly troublesome with relatively small containers, e.g., up to about 4–6 ounce volume, such as might be used for serving fruit, pudding or other food items in school lunch programs. Applicant's invention solves the problem of weak containers, even with respect to those of small size, by providing a durable container configured with reinforced sidewalls, and can be made of a material that is recyclable and disposable. Applicant's invention is also configured to provide nesting into adjacent, similar containers for compact and durable packaging during transportation, storage and use. Other advantages are described more fully below.

It is therefore an object of this invention to provide a container which is durable, recyclable, easy to fabricate, and inexpensive.

It is also an object of the present invention to provide an improved open-top container which is reinforced by ribs which wrap around the container side walls to supply reinforcement in both the axial and radial directions, while also providing for nesting into a similar container for improved transport and durability.

Another object of the present invention is to provide a container suitable for use in fast food operations which permits longer storage of food products therein while maintaining good quality.

Another object of the present invention is to provide an insulated container food package, such as a salad or pudding container.

These and other objects of the present invention will become more apparent from a consideration of the following description and drawings.

SUMMARY OF THE INVENTION

The container of the instant invention comprises a base member at a small end of the container and having an opening at a large end thereof and a side wall sloping from said base member including a substantially spirally wound rib including a portion extending inwardly and a portion extending outwardly from said sidewall.

The instant invention also provides a container comprising a foamed plastic including a base member at the smaller end of the container and having an opening at the larger end thereof and a side wall sloping substantially outwardly and upwardly from said base member having a substantially spirally wound rib extending about the perimeter thereof, said side wall at the larger end of said container including an outwardly extending shoulder.

BRIEF DESCRIPTION OF THE DRAWINGS

FIG. 1 is an enlarged bottom view of the container in accordance with the principles of the present invention.

DETAILED DESCRIPTION OF THE PREFERRED EMBODIMENT

Figure 1:
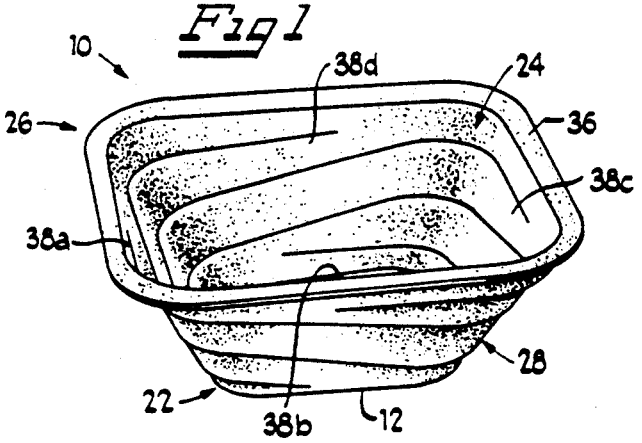
FIG. 1 is a perspective view of a container in accordance with the principles of the present invention.
Figure 2:
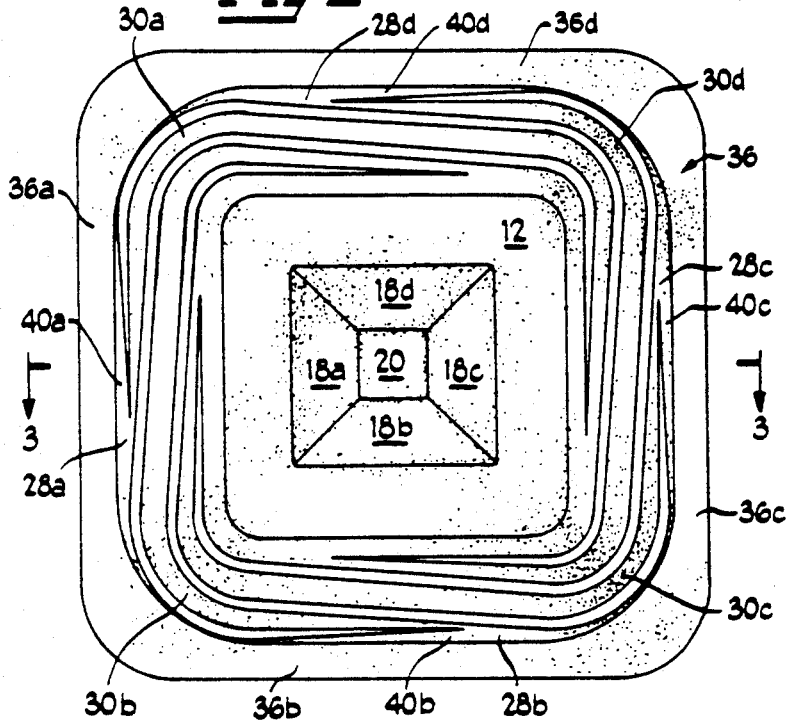
Figure 3:
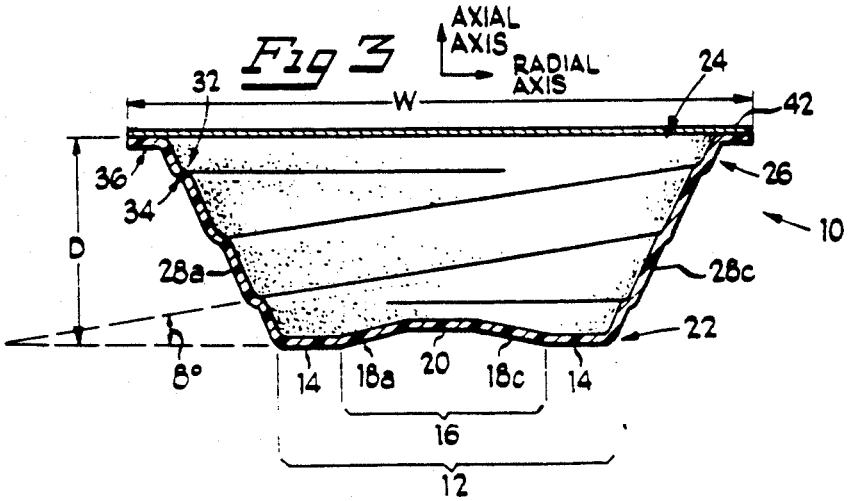
FIG. 3 is a cross-sectional view of the container taken substantially along line 3—3 of FIG. 2.

While this invention is susceptible of embodiments in many forms there are shown in FIGS. 1–3, an embodiment suitable for use in the practice of this invention, with the understanding that the present disclosure is not intended to limit the invention to the embodiment illustrated.

Illustrated in FIG. 1, is a fast food container 10. The container 10 includes a base member 12 at the smaller end 22, and at the opposite or larger end 26 thereof, there is an opening 24. A side wall 28 slopes from the base member 12 to the larger end 26 of the container 10 in a generally upwardly and outwardly direction. The side wall 28 includes at least one substantially spirally or helically-circumferentially wound rib which includes a portion 32 extending inwardly and a portion 34 extending outwardly from said sidewall 28. In a preferred embodiment, the larger end 26 of container 10 also includes an outwardly extending shoulder, lip or flange 34 which is adapted to receive a sealing layer 42 or lid for food preservation.

Referring to FIG. 3, in a preferred embodiment, the base member 12 includes an outer portion 14 and an indented or recessed inner portion 16. Referring to FIGS. 2 and 3, the inner portion 16 includes a sloped intermediate section 18 which includes sections **18*a*, 18*b*, 18*c* and 18*d* and center portion 20. The inner portion 16 is generally square shaped, thereby allowing only the outer portion 14 or perimeter to touch a flat surface, such as a table, to substantially prevent unwanted spinning which can lead to spillage of the food in container 10. The sloped sections 18*a*, 18*b*, 18*c* and 18*d* are at an incline with respect to the outer portion 14, and lead to the center portion 20, for reinforcement purposes. The base member 12 which includes outer and inner portions 14 and 16, respectively, and sloped sections 18*a*, 18*b*, 18*c* and 18*d* and center portion 20**, provides more structure for improved durability and strength as compared to a flat surface.

The side wall 28 can include various geometric shapes, such as but not limited to circular, triangular, rectangular, pentagonal, etc. from a top view, as long as nesting of adjacent containers is possible. It should be understood by those skilled in the art that the recessed portion 16 could be different or preferably the same geometric shape as the side wall 28 for facilitating the manufacture and improve strength of the container 10.

In a preferred embodiment, in FIG. 2, the side wall 28 is generally rectangular, and symmetric sections 28*a*, 28*b*, 28*c* and 28*d* for nesting purposes in the axial direction, with circular corners or apex areas 30*a*, 30*b*, 30*c* and 30*d*, therebetween, respectively for improved durability and strength as compared to square corners.

The term axial axis as used herein means a straight line extending in a direction substantially perpendicular to the base member 12 in FIG. 3. The term radial axis means a straight line extending in a direction substantially perpendicular to the axial axis and parallel to the base member 12 in FIG. 3.

Referring to FIGS. 2 and 3, the shoulder 36 provides a substantially flat and square surface around areas 36*a*, 36*b*, 36*c* and 36*d* for attaching, for example, a lid, sealing layer or material, or barrier material, with or without an adhesive, for improved sealing and extended shelf life. Moreover, shoulder 36 provides a lip for better grip or handling of the container 10 and may contribute to minimizing spillage of the contents in such container. Further, shoulder 36 provides an area to help separate one container 10 from a nested or telescopically fit second-adjacent container when packaged for improved means for separating containers from adjacent containers. The shoulder 36 is substantially parallel to base member 12, for a firm fit for a lid or a good flat surface for sealing layer or material, and includes sections 36*a*, 36*b*, 36*c* and 36*d*. As should be understood by those skilled in the art, the shoulder 36 can include indentations or recesses to interconnect or hingably connect a lid, for example, to container 10.

Referring to FIG. 3, the spirally wound rib of container 10 includes at least one inwardly extending or protruding spiral or helical rib 32 and an outwardly extending or protruding helical or spiral rib 34 which travels circumferentially around, extends about the perimeter or winds about one revolution or less around side wall 28, and preferably about $\frac{3}{4}$ of a revolution for substantially improved strength and durability as compared to a side wall without such ribs 32 and 34. It should be understood by those skilled in the art that any number of inwardly and outwardly extending ribs can be utilized herein. In a preferred embodiment, there are four inwardly protruding ribs 38*a*, 38*b*, 38*c* and 38*d* extending about the perimeter thereof as illustrated in FIG. 1, and four outwardly protruding ribs 40*a*, 40*b*, 40*c* and 40*d*, also extending about the perimeter thereof, as illustrated in FIG. 2, for improved nesting. The side wall 28 has been designed with such ribs for reinforcement purposes, aesthetics, stackability, improved durability, and has many other utilitarian purposes as more fully described hereafter. For example, the inwardly extending rib 32 helps to facilitate and direct liquid in container 10 downwardly toward the base member 12 of container 10. If powders or solids are in container 10, the inwardly extending rib 32 helps to keep such solids nearer to the opening 24 for more body, better appearance of the food therein, reinforcement and nesting. The outwardly extending rib 34 provides a better grip for someone to handle the container 10, as well as reinforcement.

The container 10 is particularly suitable for use in fast food operations and for permitting longer storage of food products while maintaining good quality. The inwardly extending rib 32 on the interior of side wall 28 of the container 10, permits air circulation between a prepared food product for contributing to the freshness of the food therein.

As previously stated, the container 10 of the instant invention particularly adapted to providing improved nesting. More particularly, with inwardly and outwardly extending ribs 32 and 34, nesting can be accomplished by inserting one container into a second, which allows the inner ribs of the first container to inter-connect securely with the outer ribs of the second adjacent container inside the first, to substantially minimize the possibility of the nested containers from coming apart during transport. In addition, the tight nesting engagement construction of container 10 allows a minimal amount of predetermined space in the form of axial space between adjacent nested containers, to minimize sticking and binding which would make it difficult to separate the nested containers. Accordingly, containers constructed according to the present invention may be nested easily into one another with a minimal amount of lost space, and advantageously have a considerable resistance against deformation in both the radial and axial directions. Furthermore, nested containers 10 according to the instant invention, have the additional advantage that a plurality of containers nested into one another are securely linked as a unit thereby minimizing damage during transport and substantially preventing loose packaging or rattling, while being densely packaged and taking up a minimal amount of space.

The ribs 32 and 34 extend generally in the radial direction, as illustrated in FIG. 3, and accomplish the desired objective of furnishing stiffness in both axial and radial directions. Beads or projections of the type used previously, which run merely circumferentially around the side wall in a flat plane parallel to the base member 12 of container 10, have the desired property of reinforcing the container against radial and transverse forces, but the disadvantage of actually weakening the body in an axial direction, allowing it to extend or collapse in accordion fashion. On the other hand, longitudinal beads running perpendicular to the base member 12 along sidewall 28 have a tendency to reinforce the side wall against axial compression, but tend to weaken it to pressures in the radial direction. By contrast, the spirally wound ribs 32 and 34 advantageously reinforce the side wall 28 in both the (longitudinal) axial and radial directions, and permit a balanced strength to be achieved by proper choice of the angle of inclination or pitch of the ribs with respect to the base member 12.

Referring to FIG. 3, the inwardly and outwardly extending ribs 32 and 34, are positioned at an angle relative to a horizontal or radial axis which can vary widely, preferably ranging up to about 30° for symmetric sections 28*a*, 28*b*, 28*c* and 28*d* for improved nestability in any position, and most preferably ranging up to about 10° or less, and typically about 8° for best nesting and symmetry of sections 28*a*, 28*b*, 28*c* and 28*d*.

The container 10 includes a width defined as the distance from one side of the shoulder 36 to the other side, indicated as item W in FIG. 3, and a depth, defined as the distance from the larger end 26 to the smaller end 22, indicated as item D, wherein the width is substantially greater than the depth, preferably the width is at least about two times greater than the depth to provide increased durability and stiffness. Moreover, the construction of the container of this instant invention is particularly adapted for use as an insulated fast food bowl or container for retaining the desired temperature for a longer period of time.

Referring to FIG. 3, the side wall 28 is designed at an angle relative to the base member 12 which range widely, preferably the angle ranges from about 85° to about 55° to provide a strong nest with an adjacent container, and more preferably about 75° to about 65°, and typically about 70° for improved nesting and easy release from the mold when fabricated, while also providing an insulated container when made of the appropriate material for retaining the desired temperature for a longer period of time.

Container 10 can have a capacity which ranges widely. Preferably, the container 10 has a capacity of about ten ounces or less, and most preferably is about 4 ounces for fast food or school cafeteria end uses having improved durability and performance.

The container 10 composition can vary widely, preferably container 10 comprises a thermoplastic material such as, but not limited to, polyolefins, such as polypropylene, polyethylene terephthalate, polyamides, etc. for ease of fabrication, low cost, and in many applications microwavability and the possibility to withstand severe environments, such as ovens or freezers. More preferably, the container composition comprises a styrenic foam for improved insulation properties, ease of fabrication, uniformity, strength, low cost, lightweight, attractiveness, and sufficient temperature performance.

The styrenic foam can be produced using any technique sufficient to produce a stable foam from any foamable, heat-fusible styrenic resin. Techniques to produce stable foams from foamable styrenic resins are known to those skilled in the art, for example, by injection of a blowing agent into a polystyrene to produce an extrusion mass, which is then extruded through a die. The styrenic resins used to make the styrenic foams are polymers of alkenyl aromatic compounds having the general formula:

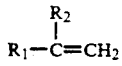

wherein $R_1$ represents an aromatic hydrocarbon radical, or an aromatic halohydrocarbon radical of the benzene or substituted benzene series, and $R_2$ is either hydrogen or the methyl radical. Styrenic resins include alkenyl aromatic compounds as the solid homopolymer styrene; alpha-methyl styrene; ortho-methyl styrene; meta-methyl styrene; para-methyl styrene; the solid copolymers of one or more of such alkenyl aromatic compounds with amounts of other polymerizable compounds such as methylmethacrylate, acrylonitrile, maleic anhydride, acrylic acid, and the like; impact polystyrene, which is a polystyrene modified by or containing elastomer moieties, such as styrene butadiene or polybutadiene; and blends of a styrenic resin such as polystyrene/poly(2,6-dimethylphenylene oxide).

In a preferred embodiment, the container 10 with base member 12 and side wall 28 is configured to have a substantially uniform thickness and density throughout for improved durability, performance and aesthetics. When constructed of styrenic foam, the container 10 has a density which can range widely, and preferably ranges from about 2 lbs/ft$^3$ to about 5 lbs/ft$^3$ for a light weight, durable and low cost container.

In a preferred embodiment, the homopolymer styrene or polystyrene container of the instant invention can include a laminate or coating on or adhered to the styrenic foam. The coating can comprise any conventional laminates or coatings typically coated on or to a styrenic foam. In one embodiment, the polystyrene container 10 can be coated on the inside, outside or both. A coating or lamination on the interior of container 10 is beneficial for improved durability, for example, for cut or poke resistance from a fork or knife, improved temperature resistance to heat and cold, and a smoother interior surface for allowing a fork, or spoon to slide there along with less drag resistance. A coating or lamination on the exterior of polystyrene container 10 is beneficial for improved durability, temperature resistance and overall attractiveness. A double coating or lamination on both the interior and exterior of the polystyrene container 10 is beneficial for the previously stated reasons, and also for even more improved insulation, durability, strength, and temperature resistance.

Also in a preferred embodiment, for certain applications, the aforementioned laminates or coatings of the instant invention can comprise a barrier layer made with a thermoplastic resin which has oxygen barrier properties. The term "barrier resin" as used herein, means a thermoplastic resin having oxygen barrier properties as discussed more fully below. Referring to FIG. 3, the polystyrene container 10 can include a layer of the barrier resin in conjunction with a lid or sealing layer 42 or material attached to shoulder 36, for example, to maintain a desired, modified atmosphere, such as, for example, a low oxygen content for food preservation, within the container 10. In a preferred embodiment, the barrier layer is extrusion coated on or to the interior of the polystyrene container 10 for improved properties such as extended shelf life and food preservation therein. However, it should be understood by those skilled in the art, that a barrier layer could be coated to the exterior or both the interior and exterior of container 10.

In general, the resin used in the barrier layer has an oxygen permeability of about 10.0 or less as measured in cubic centimeters of $O_2$ permeation per mil of barrier layer thickness per 100 square inch of surface area of the barrier layer per day, measured at one atmosphere and 23° C. (hereinafter referred to as "$O_2$ permeation rate"). Preferably, the barrier resin has an $O_2$ permeation rate of about 5.0 or less, and more preferably about 1.0 or less for improved shelf life. Preferably, the barrier resin also is processable without significant changes in the barrier resin's mechanical properties, processability or appearance at the temperatures used in extrusion coating of the particular polystyrene, which are generally from about 350° F. to about 500° F. The barrier resin is selected so as to be capable of being extrusion coated or laminated into a thin layer without cracks on the styrenic material. The barrier resin is selected from at least one member of the group consisting of copolymers of ethylene and vinyl alcohol (referred to herein as EVOH) and polymers comprising a copolymer of acrylonitrile because EVOH and these polymers have sufficient oxygen barrier properties, yet can be recyclably reclaimed or reused when these materials are extrusion coated to a styrenic foam since compatibilizers are not necessary. Other oxygen barrier resins, such as saran (polyvinylidene chloride) can be used, but are not preferred because they are believed to be less suited for recycling than other materials, because compatibilizers are required.

The polymers comprising a copolymer of acrylonitrile useful in the invention have the oxygen barrier properties discussed above and include copolymers such as a copolymer of 70 weight percent acrylonitrile and 30 weight percent styrene and graft polymers comprising a copolymer of acrylonitrile and methylacrylate in any suitable proportion, grafted in any suitable proportions onto a butadiene elastomer. A suitable graft polymer available commercially, is sold by British Petroleum Chemical Company as BAREX® and is 90 weight percent of a copolymer of 74 weight percent acrylonitrile and 26 weight percent methylacrylate grafted onto 10 weight percent of butadiene rubber.

In one embodiment, the barrier resin is an EVOH because of their excellent oxygen barrier properties in thin films. EVOH can be produced by any suitable technique such as the known saponification of an ethylene vinyl acetate copolymer. Ethylene vinyl alcohol copolymers are available commercially from EVALCA, for example, an F101 grade EVOH, and any desirable EVOH copolymer can be used having sufficient oxygen barrier properties. Blends of EVOH with other polymers such as polyethylene and any needed compatibilizing agent may also be used in the barrier layer.

Preferably, the barrier layer comprises the barrier resin contained in one layer of a thermoplastic multilayer barrier film. Any suitable multi-layer barrier film comprising the barrier resin can be used, and such barrier films generally contain one or more adhesive or tie layers. Other layers in such films add other properties to the film, such as moisture resistance or heat sealability. Techniques for producing such multi-layer barrier films are known to those skilled in the art. Any suitable technique can be used to produce the film comprising the barrier resin. The barrier film can be produced by coextrusion of the layers making up the barrier film.

The container 10 of this invention can be made in any conventional manner, for example by vacuum forming, injection molding, etc. or preferably by thermoforming a polystyrene foam sheet for low cost, disposability and recyclability. As previously stated, however, other plastic materials can also be used.

The foamed sheet material is typically made by extrusion using a blowing agent wherein the polystyrene is heated in an extruder and is mixed in the extruder with a gaseous or volatile blowing agent and then extruded through a die and allowed to expand to form a polystyrene foam sheet.

The polystyrene foam sheet can advantageously be extrusion coated, for example, by the process described in U.S. Pat. Nos. 3,616,020 or 3,669,794, to add a coating or coatings to produce multi-layer foam sheets.

Although specific embodiments of this invention have been shown and described, it is to be understood that various modifications and substitutions, as well as rearrangements and combinations of the preceding embodiment, can be made by those skilled in the art without departing from the novel spirit and scope of this invention.

That which is claimed is:

1. A foamed plastic container comprising a base member disposed in a substantially horizontal plane at a small end of the container, an opening at a larger end thereof, and a plurality of interconnected side walls formed integrally with said base member and sloping substantially outwardly and upwardly from said base member, said sidewalls comprising a substantially spirally wound rib having a rib portion extending outwardly from said sidewalls, wherein (i) said wound rib forms a substantially continuous spiral about said sidewalls so as to define a plurality of parallel, vertically disposed ribs on each of said sidewalls, each of said vertically disposed sidewall ribs being positioned at an angle relative to a horizontal plane which is less than about 10°; and (ii) the angle of said side walls relative to said base includes an angle of from about 85° to about 55°.

2. The container of claim 1, wherein said large end of said sidewall includes a shoulder.

3. The container of claim 1, wherein said shoulder is substantially parallel to said base member.

4. The container of claim 1, wherein said container has a capacity of about ten ounces or less.

5. The container of claim 1, wherein said container has a substantially uniform thickness throughout.

6. The container of claim 1, wherein a coating is attached to at least the inside or outside of said container.

7. The container of claim 6, wherein said coating comprises a barrier layer.

8. The container of claim 7, wherein said barrier layer is extrusion coated onto the interior of said container.

9. The container of claim 7, wherein said barrier layer comprises a barrier resin selected from at least one member of the group consisting of polyvinylidene chloride and copolymers of ethylene, vinyl alcohol and acrylonitrile.

10. The container of claim 1, wherein said foamed plastic comprises polystyrene.

11. The container of claim 1, wherein said foamed plastic has a density ranging from about 2 $lbs/ft^3$ to about 5 $lbs/ft^3$.

* * * * *